US006943736B2

(12) United States Patent
Noro et al.

(10) Patent No.: US 6,943,736 B2
(45) Date of Patent: Sep. 13, 2005

(54) ANTENNA APPARATUS

(75) Inventors: Junichi Noro, Akita (JP); Kenichi Taguchi, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 21 days.

(21) Appl. No.: 10/785,938

(22) Filed: Feb. 26, 2004

(65) Prior Publication Data

US 2004/0257282 A1 Dec. 23, 2004

(30) Foreign Application Priority Data

Jun. 17, 2003 (JP) ..... P. 2003-172543

(51) Int. Cl.[7] ..... H01Q 1/38
(52) U.S. Cl. ..... 343/700 MS; 343/846; 343/872; 333/204
(58) Field of Search ..... 343/700 MS, 846, 343/872; 333/204; H04Q 1/38

(56) References Cited

U.S. PATENT DOCUMENTS 4,197,545 A * 4/1980 Favaloro et al. ..... 343/700 MS
5,355,524 A * 10/1994 Higgins, Jr. ..... 455/82
5,523,768 A * 6/1996 Hemmie et al. ..... 343/840
6,566,169 B1 * 5/2003 Uziel et al. ..... 438/115
2004/0056816 A1 * 3/2004 Bittar et al. ..... 343/787
2004/0119654 A1 * 6/2004 Koyama ..... 343/846

* cited by examiner

*Primary Examiner*—Don Wong
*Assistant Examiner*—Binh Van Ho
(74) *Attorney, Agent, or Firm*—Whitham, Curtis & Christofferson, P.C.

(57) ABSTRACT

To enable to easily attach an LNA board onto an antenna board without bringing about an increase in fabrication cost or an increase in a number of steps. An antenna unit 3 is mounted on one face of an antenna board 4 and an LNA board 1 is mounted on other face of the antenna board 4. The LNA board 1 is formed with an end face through hole and is soldered to the antenna board 4 at the end face through hole. This soldering enables to attach the LNA board 1 on the antenna board 4 and to electrically connect a GND pattern 4*b* of the antenna board 4 and a ground pattern 1*c* of the LNA board 1.

7 Claims, 2 Drawing Sheets

ANTENNA APPARATUS

SUMMARY OF THE INVENTION

1. Field of the Invention

The present invention relates to an antenna apparatus having an LNA board, particularly relates to an improvement in a structure of mounting an LNA board to an antenna board.

2. Description of the Related Art

Conventionally, there has widely been spread a system, so-to-speak a car navigation system for inducing to guide an advancing path or the like of one's own vehicle for a driver of an automobile. According to the car navigation system, whereas a current position is specified by a speed, a running distance or the like of one's own vehicle, in order to promote positional accuracy, radio wave transmitted from a GPS satellite is received by a GPS antenna and the current position is specified also by positional information acquired from the received radio wave.

Or, in recent years, in the United States or the like, it has been promoted to provide digital radio broadcast or the like by radio wave transmitted from an artificial satellite. Also in a digital radio receiving system for receiving such a digital radio broadcast, an antenna for receiving radio wave transmitted from the satellite is also needed and a so-to-speak satellite radio receiving antenna is used.

The above-described GPS antenna or satellite radio receiving antenna is constituted by an antenna portion and an LNA (Low Noise Amp) portion, normally, attached with an antenna unit at an antenna board and attached with an LNA board formed with an LNA circuit on a rear side of the antenna board and is mounted to a roof or the like of an automobile in a state of containing the boards in a cover member.

At this occasion, it is necessary to carry out grounding for connecting a GND pattern of the LNA board and an GND pattern of the antenna board, and in a prior art, a copper tape is used, or a through hole is formed at the LNA board and the GND pattern of the LNA board and the GND pattern of the antenna board are connected by a method of soldering or the like via the through hole.

However, according to the method of using the copper tape, an extra part (copper tape) is needed, not only an increase in cost is brought about but also it is necessary to newly add a step of attaching the part by manual operation to cause to significantly deteriorate productivity. Meanwhile, according to the method of utilizing the through hole, extra cost and extra number of steps are needed in forming the through hole and therefore, the method is still disadvantageous in view of productivity or cost.

SUMMARY OF THE INVENTION

The invention has been proposed in view of such an actual situation of the prior art and it is an object thereof to provide an antenna apparatus capable of easily attaching an LNA board to an antenna board without bringing about an increase in fabrication cost or an increase in a number of steps.

In order to achieve the above-described object, an antenna apparatus according to the invention is characterized in an antenna apparatus constituted by mounting an antenna unit on one race of an antenna board and mounting an LNA board on other race of the antenna board, wherein the LNA board is formed with an end face through hole and is soldered to the antenna board at the end race through hole.

According to the antenna apparatus of the invention, the LNA board is attached to the antenna board by only carrying out the soldering at the end face through hole formed at the LNA board. At this occasion, by the soldering, simultaneously with attaching the LNA board to the antenna board, a GND pattern of the antenna board and a GND pattern of the LNA board are electrically connected and connection by a copper tape or a through hole is not needed.

DESCRIPTION OF THE PREFERRED EMBODIMENTS

A detailed explanation will be given of antenna apparatus to which the invention is applied in reference of the drawings as follows.

Figure 1:
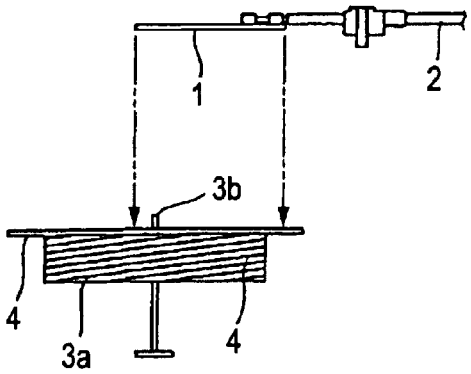
FIG. 1 illustrates views showing steps of integrating an antenna apparatus to which the invention is applied, FIG. 1(*a*) shows a step of positioning an LNA board and an antenna board, FIG. 1(*b*) shows a step of attaching the antenna board and the LNA board, FIG. 1(*c*) shows a step of positioning a shield case, and FIG. 1(*d*) shows a step of attaching the shield case, respectively.
Figure 1:
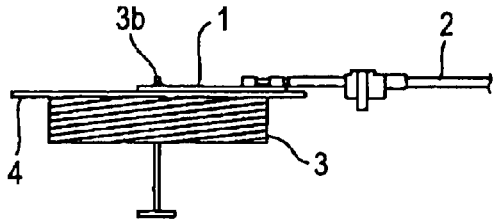
Figure 1:
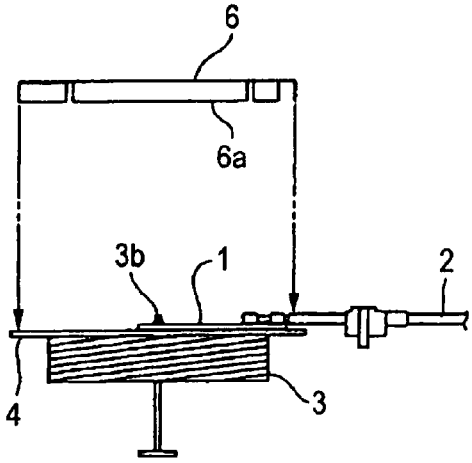
Figure 1:
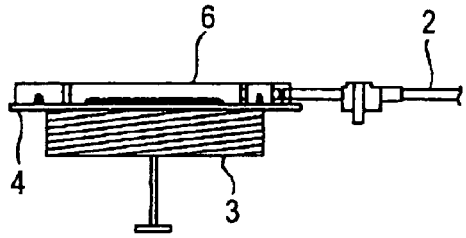

FIG. 1 illustrates views showing a series of steps of integrating an antenna apparatus to which the invention is applied. In order to integrate the antenna apparatus, first, as shown by FIG. 1(*a*), there are prepared an LNA board 1 fixedly soldered with a cable 2, and an antenna board 4 mounted with an antenna unit 3.

The antenna unit 3 is constituted by forming an antenna conductor 3*a* in a spiral shape at a peripheral face of a dielectric member in a cylindrical shape and implanting a pole antenna 3*b* at a center thereof and is mounted to the antenna board 4 by a method of soldering necessary portions or the like.

The LNA board 1 is a board counted with an LNA circuit constituted by, for example, a first stage amplifier (LNA= low noise amplifier), a band pass filter, and a second stage amplifier (LNA=low noise amplifier) and is constituted by forming a predetermined wiring pattern on an ordinary rigid board and mounting predetermined parts thereon.

Figure 2:
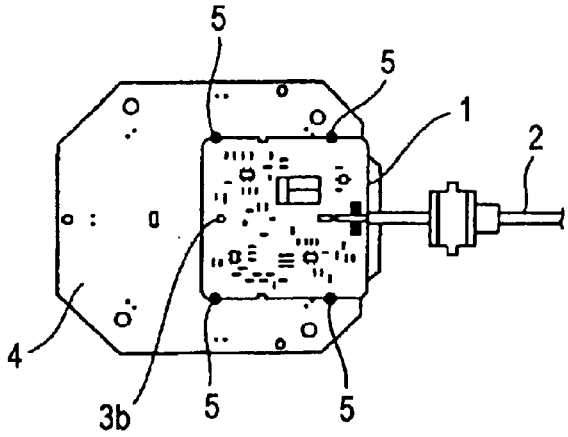
FIG. 2 is a plane view showing a state of attaching the LNA board to the antenna board.

Next, as shown by FIG. 1(*b*), the LNA board 1 is attached to the antenna board 4. At this occasion, according to the embodiment, as shown by FIG. 2, the boards are fixed by soldering four locations of a surrounding of the LNA board 1 and at the same time, a GND pattern of the antenna board 4 and a GND pattern of the LNA board 1 are connected.

Figure 3:
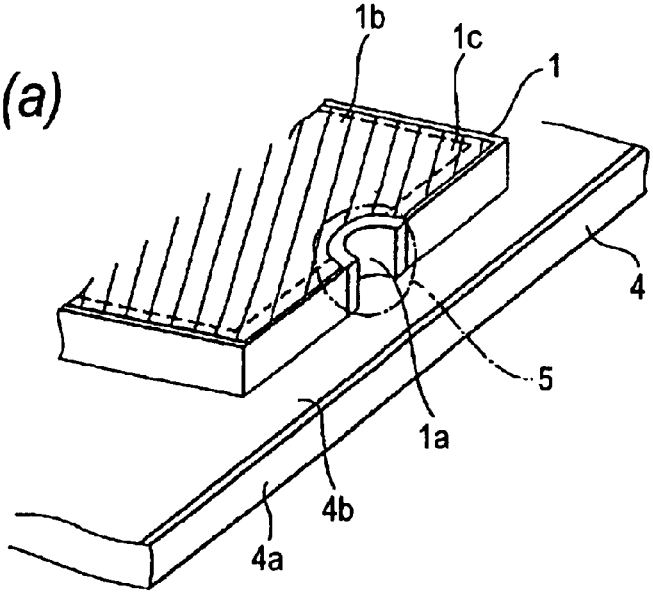
FIG. 3 illustrates views showing to enlarge a portion at a vicinity of an end face through hole of the LNA board, FIG. 3(*a*) is an outline perspective view of an essential portion and FIG. 3(*b*) is an outline sectional view of the essential portion.
Figure 3:
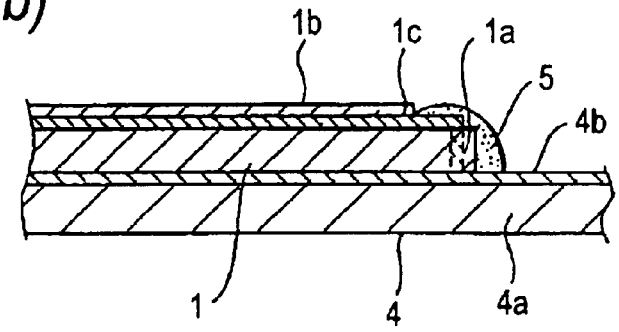

FIG. 3(*a*) and FIG. 3(*b*) are views showing to enlarge the soldered portion. A peripheral edge of the LNA board 1 is formed with an end face through hole 1*a* for soldering and the soldering is carried out at the portion. As the end face through hole 1*a*, the peripheral edge of the LNA board 1 is formed with a through hole in a semicircular shape.

A surface of the LNA board 1 is formed with various wiring patterns constituting the LNA circuit, although an insulating layer (solder resist layer) 1*b* is formed to cover the circuit, at a vicinity of the end face through hole 1*a*, the insulating layer 1*b* is slightly recessed from an edge potion of the LNA board 1 and a GND pattern 1*c* faces thereto. The GND pattern 1*c* is integrally connected to the end face through hole 1*a*.

Meanwhile, at the antenna board 4, a GND pattern 4*b* is formed over a total of a surface of a support board 4*a*.

Therefore, when the LNA board 1 is soldered to the antenna board 4 by a solder 5 at the end race through hole 1*a*, the GND pattern 1*c* of the LNA board 1 and the GND pattern 4*b* of the antenna board 4 are electrically connected by the solder 5, simultaneously therewith, the LNA board 1 and the antenna board 4 are mechanically fixed by the solder 5.

After attaching the LNA board 1, as shown by FIG. 1(*c*), a shield case 6 is covered on the side of the LNA board 1 to thereby finish the antenna apparatus as shown by FIG. 1(*d*). The shield case 6 is provided with positioning tabs 6*a* at a plurality of locations (for example, three locations) and is fixedly positioned to the antenna board 4 by fitting the positioning tabs to positioning holes formed at the antenna board 4 to solder.

The finished antenna apparatus is contained in a cover member or the like and is mounted to the roof or the like of an automobile.

As is apparent from the above-described explanation, according to the antenna apparatus of the invention, the LNA board is provided with the end face through hole and is attached to the antenna board by soldering the portion and therefore, connection by the copper tape or connection by the through hole is not needed, and the LNA board can easily be attached to the antenna board without bringing about an increase in fabrication cost and an increase in a number of steps.

Further, according to the antenna apparatus of the invention, the GND pattern is formed at the position of the antenna board in correspondence with the end face through-hole and the GND pattern is formed to face the end face through hole of the LNA board, the GND pattern of the antenna board and GND pattern of the LNA board are electrically connected by the soldering and therefore, it is not necessary to separately carry out grounding and connection by the copper tape or connection by the through hole is not needed also in this respect

What is claimed is:

1. An antenna apparatus, comprising:

a first board member, having a first face and comprising an antenna unit;

a second board member, provided on the first surface of the first board member and comprising a low noise amplifier circuit, the second board member further comprising a first face and a second face opposed to each other, and a third face connecting the first face and second face and formed with a groove which is opened at the first face and the second faces and a solder, connecting the first face of the first board member and the first face of the second board member via the groove.

2. The antenna apparatus according to claim 1, wherein: the first board member comprises a first ground pattern provided on the first face of the first board member;

the second board member comprises a second ground pattern provided on the first race of the second board member while contacting the groove and the solder electrically connects the first ground pattern and the second ground pattern.

3. The antenna apparatus according to claim 2, wherein: the second board member comprises a metal pattern provided on the groove and connected with the second ground pattern; and the solder connect the metal pattern and the first pattern so as to electrically connect the first ground pattern and the second ground pattern.

4. The antenna apparatus according to claim 2, wherein the second board member comprises an insulative layer covering at least the low noise amplifier circuit and the second ground pattern except at least a part where the second ground pattern contacts the groove.

5. A method for manufacturing an antenna apparatus, comprising steps of;

providing a first board member having a first face;

providing a second board member comprising a first face and a second face opposed to each other, and a third race connecting the first face and second face and formed with a groove which is opened at the first face and the second face;

mounting the second board member onto the first face or the first board member, and soldering the first face of the first board member and the first face of the second board member via the groove so as to fix the second board member on the first board member.

6. The method for manufacturing an antenna apparatus according to claim 5, further comprising steps of;

providing a first ground pattern on the first face of the first board member; and providing a second ground pattern on the first face of the second board member while contacting the groove, wherein the step of soldering comprises a step or electrically connecting the first ground pattern and the second ground pattern.

7. The method for manufacturing an antenna apparatus according to claim 5, further comprising steps of;

providing a metal pattern provided on the groove and connected with the second ground pattern;

wherein the step of soldering comprises a step of connecting the metal pattern and the first pattern so as to electrically connect the first ground pattern and the second ground pattern.

* * * * *